United States Patent [19]

Schluter

[11] Patent Number: 4,917,933

[45] Date of Patent: Apr. 17, 1990

[54] PLASTIC SHEET FOR LINING BUILDING SURFACES

[76] Inventor: Werner Schluter, Am Schierloh 6, 5860 Iserlohn, Fed. Rep. of Germany

[21] Appl. No.: 391,697

[22] Filed: Jul. 31, 1989

Related U.S. Application Data

[63] Continuation of Ser. No. 143,622, Jan. 13, 1988.

[30] Foreign Application Priority Data

Jan. 20, 1987 [DE] Fed. Rep. of Germany ..... 3701414

[51] Int. Cl.[4] ..... B32B 3/06; E04B 5/52

[52] U.S. Cl. ..... 428/99; 428/88; 428/107; 428/111; 428/119; 428/137; 428/156; 428/166; 428/167; 428/172; 428/174; 428/176; 428/178; 428/179; 428/180; 428/181; 428/188; 428/192; 428/223; 428/292; 52/268; 52/273; 52/334; 52/450; 52/630; 52/795

[58] Field of Search ..... 428/88, 99, 100, 107, 428/111, 119, 132, 141, 152, 156, 166, 167, 172, 174, 176, 178, 179, 180, 181, 182, 183, 188, 192, 223, 292, 294, 331, 336; 52/268, 272, 273, 296, 334, 336, 391, 390, 392, 450–454, 458, 630, 795, 799

[56] References Cited

U.S. PATENT DOCUMENTS

| | | | |
|---|---|---|---|
| 1,496,207 | 6/1924 | Carabillo | 52/450 |
| 1,574,586 | 2/1926 | Loucks et al. | 52/450 |
| 4,270,325 | 6/1981 | Mandelli | 52/391 |
| 4,355,064 | 10/1982 | Imhof | 428/188 |
| 4,558,550 | 12/1985 | Marchais et al. | 52/452 |

FOREIGN PATENT DOCUMENTS

| | | |
|---|---|---|
| 630984 | 7/1982 | Fed. Rep. of Germany . |
| 8531573 | 2/1985 | Fed. Rep. of Germany . |

OTHER PUBLICATIONS

Kleindienst et al., Abstract of German Reference 630984.

*Primary Examiner*—Ellis P. Robinson
*Assistant Examiner*—Donald J. Loney
*Attorney, Agent, or Firm*—Collard, Roe & Galgano

[57] ABSTRACT

A plastic sheet is disclosed which is used as a subcarrier for insulating linings of building surfaces. The sheet is formed by parallel, alternating, dovetail-shaped channels and grooves. A coarse-meshed lattice matting, having filaments, is glued or partially fused to the backside of the plastic sheet and serves to anchor the sheet to the underlying foundation. This lattice matting stretches over the entire backside or inner surface of the sheet. The webs of the plastic sheet are expandable and can compensate for stresses occurring between the underlying foundation and the external facing material such as ceramic tile.

2 Claims, 1 Drawing Sheet

Fig. 1
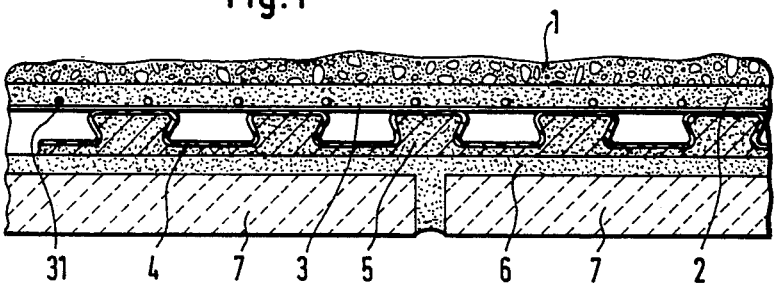
Fig. 2
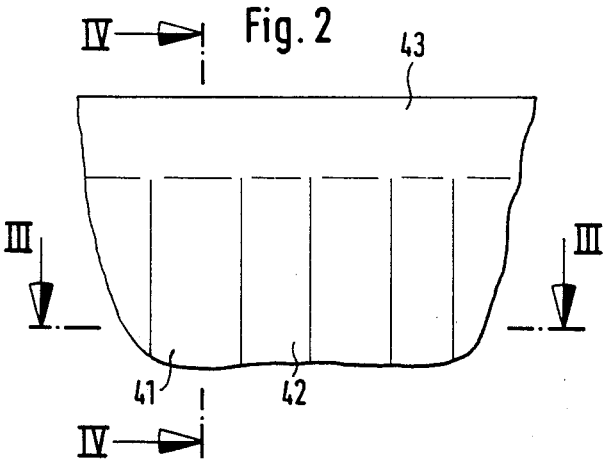
Fig. 4
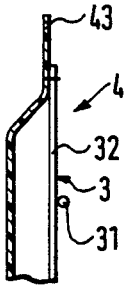
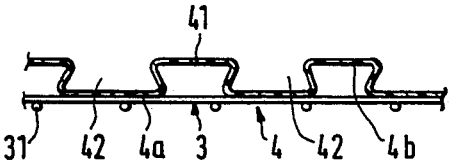
Fig. 3

PLASTIC SHEET FOR LINING BUILDING SURFACES

REFERENCE TO RELATED APPLICATIONS

This is a continuation application of application Ser. No. 143,622, filed Jan. 13, 1988 for Plastic Sheet for Lining Building Surfaces.

BACKGROUND OF THE INVENTION

1. Field of the Invention

This invention relates to an improved plastic sheet which can be used as an insulating lining between a foundation and facing materials such as ceramic tiles. More particularly, this invention relates to a plastic sheet which can compensate for different rates of thermal expansion between the underlying foundation and the external facing.

2. Description of the Prior Art

Installing external or internal building facing materials in the form of ceramic tile surfacing or plaster presents many problems. Because of the different expansion stresses within the wall or base foundations and the covering, damage often results in the form of cracks or peeling of the facing from the inside out. Moisture penetration through the facing can also induce damage when, for example, plasterboard or sheetrock is used as the underlying foundation. Ceramic tiles are frequently laid in the so-called "thin layer" process which utilizes a suitable contact adhesive. In practice, it is difficult to find suitable adhesives which are equally suited to the underlying foundation as well as the back of a ceramic tile. The materials requiring bonding are, in practice, so varied, that the choice of adhesive always involves a compromise.

Patent CH-PS 630 984 discloses a moisture-impermeable plastic sheet which serves as an insulating lining for building surfaces. This sheet has a parallel, alternating, open, sectioning, which is dovetail-shaped in cross section. Since this plastic sheet is expandable in a direction transverse to the sectioning, it enables longitudinal compensation in effecting latitudinal adjustment at the foundation. The known plastic sheet, with its webbing on the one side, forms anchoring ribs which are preferably inserted in the hardenable underlying foundation material and function as anchors. The dovetail-shaped grooves formed in this manner form openings facing outwardly which function to satisfy aesthetic requirements and to drain off moisture in a vertical direction when they are mounted vertically.

A plastic sheet of this kind, as a rule, will only adequately lend itself to mounting on a wall in a mortar or adhesive medium if the contact layer is sufficiently thick to enable the mortar or adhesive to mesh with and practically fill the dovetail-shaped grooves. The mortar or hardened adhesive filling the grooves inhibits the ability of such plastic sheet to stretch in the direction transverse to the webs when it is mounted.

The purpose of the present invention is to provide a plastic sheet which serves as an insulating lining for building surfaces. The plastic sheet has parallel, alternating, open, sectioning which is dovetail-shaped in cross section. This material can be used to create a moisture-impermeable super-structure, enabling substantial compensation of foundation- or facing-induced stresses. The choice of the bonding media to be used, such as adhesives or mortar, can be simplified by using this plastic sheet.

SUMMARY OF THE INVENTION

It is an object of the invention to provide a plastic sheet which can be used as an insulating lining between a foundation and facing materials, such as ceramic tiles.

It is a further object of the invention to provide a plastic sheet which can compensate for stress occurring between the underlying foundation and the external facing.

It is an additional object of this invention to provide a plastic lining which is easy to manufacture, simple and economical to install, and which can be used on a wide variety of foundation surfaces.

Accordingly, these objects are achieved by using a plastic sheet which has a coarse-meshed lattice matting permanently applied to one side thereof. In this configuration, the filaments of the lattice matting may partially protrude. The lattice matting is preferably pressed or partially fused into the sections forming the external contact surface of the building.

The lattice-matting side of the plastic sheet of the subject invention is glued to the building foundation by means of a contact layer. The filaments of the lattice matting serve as anchoring elements, thus substantially improving the bonding contact between the underlying foundation and the plastic sheet. The lattice matting impedes any significant penetration of the adhesive or mortar medium into the frontally exposed grooves.

The plastic sheet, which has been mounted to the building foundation in this manner, can now function as a foundation for facing materials such as, for example, ceramic tiles. These tiles can be secured in place by using a thicker layer of mortar or adhesive. The mortar is applied from the front of the sheet over the entire surface, filling up the grooves. Ceramic tile or plaster is then applied in a manner known in the art. The plastic sheet is an especially useful surface facing to compensate for stresses between the underlying foundation and the facing.

These stresses occur, for example, where walls and floors have built-in heating units. Because the grooves or channels on the back of the plastic sheet remain open, when the sheet is used as a subcarrier transversely to the webs it retains its ability to stretch or expand to a sufficient degree. Thus, the sheet is able to substantially compensate for stresses occurring between the underlying foundation and the external facing.

Also, the sheet may be provided with an unsectioned, smooth overlapping segment at the end and/or beginning of each plastic sheet section, which overlap makes it easier to install a series of sheets.

Other objects and features of the present invention will become apparent from the following detailed description considered in connection with the accompanying drawing. It is to be understood, however, that the drawing is to be used for illustration only and not as a definition of the limits of the invention.

In the drawing, wherein similar reference characters denote similar elements throughout the several views:

FIG. 1 is a cross section of a wall faced with the plastic sheet of the present invention with ceramic tiles applied thereto;

FIG. 2 is an enlarged partial elevational view of the plastic sheet shown in FIG. 1;

FIG. 3 is a sectional view along line III—III of FIG. 2; and

FIG. 4 is a sectional view along line IV—IV of FIG. 2

DESCRIPTION OF THE PREFERRED EMBODIMENT

Referring to FIGS. 1 and 3, there is shown a plastic sheet 4 having spaced hollow channels formed by parallel, alternating, "dovetail-shaped" webs or channels 41 and grooves 42. The backside 4*a* is used to mount sheet 4 to a foundation or wall 1. The front 4*b* of sheet 4 faces in the outward or external direction. Clamping elements have been provided on the inner or backside 4*a* in the form of a coarse-meshed lattice matting 3 which is glued or partially fused to backside 4*a*. Lattice matting 3 includes anchoring filaments or protrusions 31 and 32. Lattice matting 3 stretches over entire backside 4*a*. Only at the top and bottom portions of sheet 4, where a flat overlapping segment 43 is constructed, can lattice matting 3 be absent.

Because of the sectioning design, sheet 4 can be stretched or expanded in a direction transverse to channel webs 41 The individual surfaces of frontside 4*b* of plastic sheet 4 are especially smooth because, if possible, the adhesion of a putty surface must be avoided in particular applications.

Referring to FIG. 1, a bonding layer 2 made, for example, of plasterboard or sheetrock, has been applied to the underlying surface of the wall 1. Plastic sheets 4 of a corresponding size and overlap are glued to this layer 2. The overlapping section can be further sealed by applying a sealant such as luting or heat sealing to prevent moisture penetration. Lattice matting 3 provided on backside 4*a* of the plastic sheet 4 anchors itself by means of filaments 31 and 32 to the bonding layer 2, and is thus firmly attached to the underlying wall foundation. Lattice matting 3 ensures that webs or channels 41 do not fill up with the material of bonding layer 2 and remain hollow.

Surface putty or mortar 5 is applied to frontside 4*a*, penetrates into the forwardly facing grooves 42 and, by virtue of the undercuts, creates an anchoring effect. The smoothly puttied surface thus formed provides the foundation for the facing to be applied. This facing in the example shown consists of ceramic tiles 7. The appropriate adhesive 6 is applied to the putty surface 5 to secure these ceramic tiles 7. The ceramic tiles 7 are then applied using the well known thin layer process.

If plaster is to be applied, it can be applied directly on frontside 4*a* or, if necessary, to an undercoat applied o the frontside of the plastic sheet 4 on the puttied surface 5. Optionally, if plaster is to be applied, an additional coarse-meshed lattice matting having anchoring elements or protrusions may be provided on the frontside of the plastic sheet as well.

While the cross section of the channels formed by channels or webs 41 and grooves 42 has been described as "dovetail", it can be seen that other shapes such as trapezoidal may be used as long as the top or outer surface of web or channel 41 is wider than the base or inner surface thereof.

While one embodiment of the present invention has been shown and described, it will be obvious that many changes and modifications may be made there unto without departing from the spirit and scope of the invention.

What is claimed is:

1. A plastic sheet for bonding to and lining the surface of a foundation or wall onto which a covering material is bonded, wherein unequal stresses are experienced by the foundation or wall and the covering material which is compensated for by the plastic sheet, said plastic sheet having dovetail-shaped parallel grooves on the inner and outer surfaces thereof and a lattice matting applied to the inner surface of the plastic sheet including anchoring protrusions adpated to be pressed into the bonding material on the surface of the foundation or wall lined by the plastic sheet, whereby the lattice matting prevents bonding material from entering the grooves on the inner surface of the plastic sheet which remain open so as to permit the plastic sheet to stretch or expand as a result of the unequal stresses in the foundation or wall and the covering material.

2. The plastic sheet as set forth in claim 1, wherein said grooves and said anchoring protrusions extend only to within a predetermined distance of adjacent edges, thereby forming a smooth segment for overlapping adjacent sheets.

* * * * *